US010667603B1

(12) United States Patent
Williams et al.

(10) Patent No.: US 10,667,603 B1
(45) Date of Patent: Jun. 2, 2020

(54) CONVERTIBLE SHELVING II

(71) Applicants: Nikita Maria Williams, Rochester, NY (US); Meshach Claudinei Cornelius, Rochester, NY (US)

(72) Inventors: Nikita Maria Williams, Rochester, NY (US); Meshach Claudinei Cornelius, Rochester, NY (US)

( * ) Notice: Subject to any disclaimer, the term of this patent is extended or adjusted under 35 U.S.C. 154(b) by 0 days.

(21) Appl. No.: 16/602,045

(22) Filed: Jul. 25, 2019

Related U.S. Application Data

(63) Continuation-in-part of application No. 15/999,865, filed on Aug. 22, 2018, now abandoned.

(51) Int. Cl.
*A47B 43/00* (2006.01)
*A47B 96/02* (2006.01)
*A47B 95/00* (2006.01)

(52) U.S. Cl.
CPC ..... *A47B 43/00* (2013.01); *A47B 95/008* (2013.01); *A47B 96/024* (2013.01)

(58) Field of Classification Search
CPC ..... A47B 43/00; A47B 96/024; A47B 95/008; A47B 45/00; A47B 57/06; A47B 43/04; A47F 5/10
USPC ..... 211/195, 202, 169, 173, 174, 198, 211/DIG. 1, 189, 175, 207, 186, 149, 150; 108/99, 134, 152
See application file for complete search history.

(56) References Cited

U.S. PATENT DOCUMENTS 485,068 A * 10/1892 Sugg ..... A47B 1/04 108/69
498,563 A * 5/1893 Montgillion ..... E04B 2/7411 52/317
1,043,950 A * 11/1912 Martin ..... A47B 23/02 108/5
2,205,193 A * 6/1940 Goldman ..... A47B 43/006 108/135
2,268,732 A * 1/1942 Walter ..... A47C 16/025 297/2
2,291,381 A * 7/1942 Drake ..... A47F 7/0028 248/37.6
2,474,036 A * 6/1949 Curley ..... H01F 7/0247 335/285
2,517,183 A * 8/1950 Dunn ..... A47B 5/04 248/240.3
2,565,624 A * 8/1951 Phelon ..... A47G 21/14 335/285

(Continued)

*Primary Examiner* — Jonathan Liu
*Assistant Examiner* — Devin K Barnett

(57) ABSTRACT

A convertible shelving II unit includes one or more flat board forming a back panel configured to hang on a wall or attach to a metal surface, further includes rear face hinges, thereby allowing back panels to fold back to back. The present convertible shelving II unit includes one or more collapsible shelves hinged to the back panel. A bracket rod attached to shelves rotates down to support upright shelves and rotates up to collapse shelves, thereby allowing convertibility to extend height clearance between shelves. Wall mount holes and high-performance magnets on rear face of back panels configured to hang on a wall and attach to a metal surface. Back panels and shelves collapse parallel to each other includes convertibility to extend height of the shelving unit by attaching additional back panels end edge to end edge. The back panels can be unhinged and used on different surfaces.

1 Claim, 5 Drawing Sheets

(56) References Cited

U.S. PATENT DOCUMENTS 2,565,625 A * 8/1951 Phelon ..... A47G 21/14 335/285
2,598,128 A * 5/1952 Liechty ..... A47B 19/08 108/13
2,908,397 A * 10/1959 Patterson ..... A47F 5/0087 108/179
2,949,192 A * 8/1960 Maliff ..... G09F 5/00 211/49.1
2,985,313 A * 5/1961 Debow ..... G09F 5/00 211/135
D196,160 S * 8/1963 Patterson ..... D6/675.2
3,132,745 A * 5/1964 Steiner ..... D06F 57/12 211/119.1
3,326,149 A * 6/1967 Mitchell ..... A47B 47/04 108/60
3,434,769 A * 3/1969 Salet ..... B65D 9/14 312/258
3,608,221 A * 9/1971 Harris ..... A47G 1/065 40/605
3,726,412 A * 4/1973 Resnicoff ..... A47F 5/112 211/135
3,817,396 A * 6/1974 Markson ..... A47F 5/105 211/198
4,030,219 A * 6/1977 Donovan ..... G09F 15/0068 40/605
4,106,735 A * 8/1978 Partain ..... B60P 7/12 211/43
4,155,312 A * 5/1979 Thorkildson ..... A47B 45/00 108/102
4,488,653 A * 12/1984 Belokin ..... A47F 5/005 108/61
4,497,412 A * 2/1985 Labelle ..... A47G 21/14 206/350
4,500,146 A * 2/1985 Peterson ..... A47B 45/00 108/102
4,582,003 A * 4/1986 Valero ..... A47F 5/116 108/179
4,667,833 A * 5/1987 Jamison ..... G09F 15/0068 160/135
4,676,383 A * 6/1987 Sheffer ..... A47F 5/112 211/135
4,727,994 A * 3/1988 Beaulieu ..... A47B 19/06 16/333
4,949,851 A * 8/1990 Shaffer ..... A47F 5/116 211/149
5,026,015 A * 6/1991 Patrick ..... A47B 96/06 211/186
5,033,758 A * 7/1991 Levy ..... B62B 3/02 280/35
5,137,160 A * 8/1992 Santucci ..... A47B 45/00 211/153
5,183,166 A * 2/1993 Belokin, Jr. ..... A47F 5/116 211/130.1
5,201,120 A * 4/1993 Patrick ..... A47B 96/06 211/186
5,265,971 A * 11/1993 Duc ..... F16B 12/12 403/231
5,284,256 A * 2/1994 Correll-Antoun ..... A47B 63/00 211/198
D355,551 S * 2/1995 McNamara ..... D6/705
5,421,646 A * 6/1995 McNamara ..... A47B 45/00 108/102
5,639,138 A * 6/1997 Smith ..... A47F 5/08 294/142
5,760,668 A * 6/1998 Testa ..... B23Q 3/1546 335/285
5,782,366 A * 7/1998 Garza, Jr. ..... A47F 7/146 211/169
6,119,875 A * 9/2000 Smith ..... A47F 5/112 211/195
6,142,321 A * 11/2000 West ..... A47B 45/00 108/143
D444,655 S * 7/2001 West ..... D6/574
D444,656 S * 7/2001 West ..... D6/574
D445,620 S * 7/2001 West ..... D6/574
D455,585 S * 4/2002 West ..... D6/705.7
D510,223 S * 10/2005 Jablow ..... D6/574
7,007,614 B2 * 3/2006 Gaunt ..... A47B 45/00 108/102
7,131,546 B1 * 11/2006 Price ..... A47F 5/00 211/86.01
D533,735 S * 12/2006 Carlsson ..... D6/682.2
7,150,364 B2 * 12/2006 Jablow ..... A47B 45/00 211/153
D537,276 S * 2/2007 Kelman ..... D6/675.4
7,537,125 B2 * 5/2009 Plouchart ..... B25H 3/04 211/198
7,987,799 B2 * 8/2011 Lange ..... A47B 45/00 108/102
8,724,312 B2 * 5/2014 Jones ..... G06F 1/1632 361/679.41
8,770,416 B1 * 7/2014 Guida ..... A47F 5/08 211/10
8,875,908 B2 * 11/2014 L'Hotel ..... A47B 47/06 211/72
8,967,402 B2 * 3/2015 Pintur ..... A47F 5/0018 211/103
9,198,508 B1 * 12/2015 Kufel ..... A47F 5/116
9,271,584 B1 * 3/2016 Weinstein ..... A47F 5/135
9,559,499 B2 * 1/2017 Alvarez ..... H02B 1/01
9,844,282 B2 * 12/2017 Smith ..... A47F 5/116
D834,862 S * 12/2018 Dart ..... D6/705
2004/0164655 A1 * 8/2004 Wood ..... A47B 45/00 312/205
2004/0256335 A1 * 12/2004 Sholem ..... B25H 3/04 211/70.6
2005/0109717 A1 * 5/2005 Armstrong ..... B41K 1/58 211/39
2007/0210024 A1 * 9/2007 Haake ..... B60R 7/02 211/149
2008/0017638 A1 * 1/2008 Bradford ..... B65D 19/18 220/6
2008/0257843 A1 * 10/2008 L'Hotel ..... G09F 15/0056 211/195
2009/0308287 A1 * 12/2009 Chen ..... A47B 5/04 108/42
2011/0174754 A1 * 7/2011 Entz ..... A47B 43/00 211/202
2014/0014607 A1 * 1/2014 Mikich ..... A47B 43/00 211/195
2014/0027396 A1 * 1/2014 Landry ..... A47B 43/00 211/149
2015/0041420 A1 * 2/2015 Zelek ..... A47B 43/00 211/149
2015/0083682 A1 * 3/2015 Barre ..... A47B 43/003 211/118
2015/0257515 A1 * 9/2015 Bernard ..... A45D 44/02 211/33
2017/0164741 A1 * 6/2017 Coney ..... A47B 43/003
2018/0258965 A1 * 9/2018 Danko ..... F16B 5/0084

* cited by examiner

CONVERTIBLE SHELVING II

CROSS REFERENCE TO RELATED APPLICATION

This application claims benefits to a prior application Ser. No. 15/999,865.

FIELD OF INVENTION

The present invention relates to shelves and more particularly for use to solve a shelving solution for constricted or limited like a college dorm room, studio apartment, having versatility to adhere to a side of a metal filing cabinet, to a library metal dumb waiter or to a metal school locker. Where constricted or limited spaces exists, the present invention convertible shelving II unit is configured to hang on a wall mounted with a nail or picture hanger and is configured to attach to a metal surface with high-performance magnets affixed on rear face of a flat board forming a back panel of the present invention. The present invention convertible shelving II unit includes one or more collapsible hinged flat board forming a back panel, thereby allowing the back panels to collapse back to back or to detach from each other and be used in different locations. Each back panel of a convertible shelving II unit having one or more shelves hinged on front face of a back panel. By rotation of a bracket rod clamped to underside of shelves, shelves provide to adjust a height clearance between shelves. The bracket rod clamped to underside of shelves rotates down parallel to a back panel of the present invention convertible shelving II unit to support shelves when shelves are in use upright, perpendicular to the back panel. The bracket rod rotates up parallel to shelves provide to collapse shelves. The present invention shelving unit can fold up, collapse onto itself to easily transport or for convenient stow away. All parts of the present invention are pre-attached to each other so there is not a need for the end user to put together the convertible shelving II unit, eliminating a need for tools.

BACKGROUND

A problem with shelving units commonly found is that they have rigid back panels with rigid sides making their mobility limited, and lack flexibility making it difficult to use and fit in confined spaces. Further problematic is the single purpose usage to solve a specific problem, e.g. organize tools, organize lockers. Additional problem exists with common shelving units that allow movement of shelves. The adjustment requires detachment, and repositioning often by means of help from another person costing significant time and sweat equity simply to adjust shelves at a different level. Other found shelving units have three sides with a back panel attached to a rigid top board connected to rigid side panels having rigid fixed shelves attached to the back panel and side panels. With that shelving unit, access to the surface of the shelves is from the front only. The usefulness of this type of shelving is bound by having adequate space to house it. Requiring user to put it together, other shelving units having rectangular shelves anchored inside a four-sided rectangular structure with four post columns where shelves are tangent to and anchored to the columns. Without rigid sides, an open shelving unit shelves can be accessed from all sides. Often, the user is restricted where the shelving can fit. Likewise, such a shelving unit is often dependent on being next to a wall for stability, limiting its mobility and where it can be used. There are some shelving units that permit the user to adjust the shelves' height which requires detaching desired shelves, taking apart shelving from a post frame and placing connections at different positions on the four corner posts. Often the user will need help to horizontally adjust the shelves due to the shape and size of it. Still other, shelving units that are already put together at point of purchase have three sides with a rigid back panel connected to two rigid side panels where the hinged side panels fold inward into the center of the back panel having hinged shelves that fold down and lift up. The shelves, use is entirely reliant on being able to rest on the inside lip of its shelving unit side panels. The usability of that shelving unit is contingent on the side panels being laterally open at a ninety-degree angle from a back panel in order for that shelving unit to stand where shelves can then be accessed and placed upright for use. That type of shelving unit limits its use due to the need for its side panels to be open to stabilize the shelving unit and to actually use the shelves. A free-floating shelving unit made for use in school lockers have a specific function to hang by rope or cords from inside the locker. That shelving unit is specific in its use limiting it to a specific space, a school locker. Another shelving unit made specifically for use in school lockers has shelves dependent on the locker sides to hold the angled shelves in place. A problem with prior shelving units is the restriction caused by the rigid three and or four-sided structure making it difficult to fit in some spaces. Further problematic is the single purpose function of only standing upright on a floor or just for use in a school locker. The problem with other shelving units that have movable shelves or shelves that fold down, they rely on lateral sides of a shelving unit to support shelves. Still with most shelving units, a user is required to put together all or some of the shelving unit. Another problem with many prior found shelving units in the past is that most are difficult to fit in a space due to the shelving unit's rigidity, size and dimension.

There is a clear, specific and explicit need for a new, novel and innovative shelving unit invention, because none of the prior art provides function, mobility and versatility for use in restrictive spaces.

SUMMARY OF THE INVENTION

The present invention comprises a convertible shelving II unit having one or more hinge on a rear face of a flat board forming a back panel of a shelving unit with one or more shelves hinged to the back panel. The flat board forming the back panel is configured to mount on a wall and configured to mount on a metal surface for use to solve a shelving need in constricted or limited spaces like a college dorm room, studio apartment, having versatility to adhere to a side of a metal filing cabinet, a library metal dumb waiter or to a metal school locker.

Accordingly, it is preferred that the present invention flat board forming a back panel and shelves includes the versatility to convert, collapse and adjusts. It is preferred for the back panel and shelves to be convertible, in that, the entire shelving unit folds up. Wherein, the present invention can be installed on a wall or attach to a metal surface. The result is that the end user has access to shelving in difficult or unused areas or spaces having flexibility, usability, mobility in where the present invention provides shelving solution in constricted or limited spaces like a college dorm room, studio apartment, having versatility to adhere to a side of a metal filing cabinet, to a library metal dumb waiter or to a metal school locker.

The present invention comprising one or more flat board forming a back panel of a shelving unit, having one or more sections can unhinge, detach and be separated for simultaneous use in separate locations and on different surfaces, e.g. a wall and a metal surface. Further comprising the versatility to collapse, fold one or more convertible shelving II unit back panel when they are attached to afford easy mobility and stow away. One or more hinged flat board forming a back panel can fold with rear face of back panels touching each other. Wherein, a position of a hinged flat board forming a back panel of a shelving unit is vertical when in use. Further comprising, stabilization to prevent unintended backward collapse of one or more flat board forming the back panel, one or more countersunk high-performance magnets, using a countersink screw or by use of a two-part epoxy are placed on an end edge of back panels where flat boards forming a back panel meet end to end, end edge to edge, thereby allowing a high-performance magnet inserted flush with a surface of an end edge. The present invention includes one or more countersunk high-performance magnets placed on back panels' top and bottom end edge where back panels meet end to end, thereby allowing back panel convertibility to add more back panels to extend a height of the back panel of a shelving unit. The present invention convertible shelving II unit hinged flat boards forming a back panel can be separated and used in different locations for different purposes on different surfaces, e.g. a wall and or a metal surface.

The present invention comprising one or more shelves hinged to a front face of a back panel of a shelving unit are configured to lay down, collapsed parallel to the back panel of shelving unit when not in use or when a height adjustment is needed of the usable space between shelves to expand clearance and increase space between shelves. Further comprising, one or more shelves includes a ninety-degree bracket rod attached to underside of shelves, further includes one or more two-hole saddle clamp with one or more screws to hold the upper arm of a bracket rod centered affixed to underside of shelves and extends forward from a back panel. The bracket rod's lower arm rotates up parallel to shelves to configure shelves collapse and rotates down parallel to the back panel to configure shelves, upright when in use. When shelves are in use, extended upright, perpendicular at ninety-degrees from back panel of shelving unit, shelves are braced by a bracket rod. Wherein, the bracket rod's lower arm rotates down parallel to a back panel when shelves are upright in use perpendicular to the back panel. Wherein, one or more bracket rod's lower arm when down in vertical position parallel to the back panel will be held in place and secured by at least one one-hole single line clamp with screw affixed to the back panel of convertible shelving II unit present invention.

Further comprising one or more wall mount holes on rear face of one or more flat board forming back panels of convertible shelving II unit present invention configured to hang on a wall, e.g. using a sixty to one-hundred-pound picture hanger. Wherein, the diverse use of convertible shelving unit configured to attach to metal surface like a side of a file cabinet, a library metal dumb waiter or a metal school locker, make use of one or more high performance magnets, e.g. PowerMags, attached to surface of rear face of one or more flat board forming a back panel of the present invention shelving unit.

Accordingly, the principle object of the present invention to provide convertible shelving having one or more hinged collapsible back panel configured to hang from a wall and configured to attach to a metal surface. Wherein, one or more wall mount hole and one or more high performance magnet attach to surface of rear face of one or more back panel of convertible shelving II unit. One or more back panel may be formed of any suitable material, including wood, plastic or metal.

It is another principle object of the present invention to provide convertible shelving having one or more hinged shelves adjustable, includes one or more bracket rod that supports one or more shelves when shelves are in use upright, perpendicular to back panel, further includes a bracket rod that rotates the bracket rod's lower arm parallel to underside of shelves for collapse position. One or more shelves may be formed of any suitable material, including wood, plastic or metal.

Still another object of the present invention to provide a versatile and adjustable convertible shelving II unit having one or more shelves that collapse to increase the height clearance between shelves.

It is another object of the present invention to provide convertible shelving having one or more hinged back panel that collapses for easy mobility of the present invention shelving unit and make stow away with ease.

It is a further object of the present invention to provide convertible shelving II unit having one or more back panel and one or more shelves with the flexibility to be used in constricted or limited spaces like a college dorm room, studio apartment, having versatility to adhere to a side of a metal filing cabinet, to a library metal dumb waiter or to a metal school locker.

Still another object of the present invention to provide a collapsible shelving unit for easy stow away and for moving shelving unit to different places around a living or work space. Wherein, the one or more back panel of shelving unit and one or more shelves collapse, fold on each other lying parallel.

It is an object of the present invention to provide the versatile use of wall space, thereby allowing the present invention to hang on a wall with an end edge of a back panel resting on a floor or suspend the present invention on a wall where an end edge of a back panel does not contact the floor.

Still another object of the present invention includes one or more countersunk high-performance magnets placed on back panels' top and bottom end edge where back panels meet end to end, thereby allowing back panel convertibility to add more back panels to extend a height of the back panel of a shelving unit.

It is a further object of the present invention to provide effective use of space on metal surfaces, e.g. the side of file cabinets, library dumb waiters, school lockers.

Still another object of the present invention is to provide for the entire convertible shelving unit collapsible, adjustable, mobile, versatile to be used on diverse surfaces constricted or limited spaces.

It is an object of the present invention one or more wall mount holes on rear face of one or more flat board forming back panels of convertible shelving II unit present invention configured to hang on a wall, e.g. using a sixty to one-hundred-pound picture hanger.

Still another object of the present invention configured is to attach a rear face of a back panel of the present invention to a metal surface, e.g. side of file cabinet, library dumb waiter or school locker, includes one or more high performance magnets, e.g. PowerMags, attached to rear face of a back panel.

It is another objective of the invention to provide the remedy to utilize narrow, constricted, limited, confined spaces and tight spots for shelving and provide a shelving solution in places like college dorm rooms, studio apartments, office space next to file cabinets and for school lockers.

Still it is another objective of the present invention to provide all parts pre-attached of a convertible shelving II unit that eliminates a need for tools to put shelving unit together. The shelving unit would be put together in advance eliminating screwdrivers or other sharp ended tools where prohibited, e.g. schools.

It is further an object of the present invention to provide ease of use by end user not having to put it together.

It is an object of the present invention to provide improved, user-friendly, easy mobility, easily stowed away, effective use for its stated intended purpose.

Accordingly, the present invention provides the solution and meets the needs for utilizing constricted or limited spaces for shelving needs and affords versatility. A need will be seen for the present invention for convertible shelving II unit comprising one or more collapsible shelves attach to one or more collapsible flat board forming a back panel of a shelving unit providing ease of use in constricted or limited spaces. The present invention further includes the means to hang on a wall. Further comprising, the present invention affixes to metal surfaces by means of high-performance magnets. The present invention is configured to hang on a wall and affix to a metal surface.

DETAILED DESCRIPTION OF THE INVENTION

The present invention comprises a convertible shelving II unit for shelving having one or more flat board forming a back panel and having one or more shelves which is configured to hang from a wall and affix to a metal surface. The present invention has adjustable, collapsible and versatile functions for use on walls, and metal surfaces. The present invention uses hinges and high-performance magnets to secure and hold one or more back panels to each other, wherein, hinged shelves attached to the back panel of convertible shelving II unit. The present invention includes one or more countersunk high-performance magnets placed on back panels' top and bottom end edge where back panels meet end to end, thereby allowing back panel convertibility to add more back panels to extend a height of the back panel of a shelving unit.

The present invention has collapsible shelves that can be adjusted to change a height of clearance above and between shelves. One or more rotating bracket rod upper arm is clamped to underside of shelves by one or more two-hole saddle clamp with screws. A bracket rod's lower arm rotates down ninety-degrees to stabilize shelves upright, perpendicular to the back panel when in use and a bracket rod support stop attached to the back panel secures the bracket rod in place. The bracket rod's lower arm rotates up ninety-degrees parallel to underside of shelves to configure collapse shelves. The present invention is configured to hang from a wall using at least one wall mount hole on rear face of a back panel of convertible shelving II unit, wherein, high performance magnets affix to rear face of the back panel to configure it to hang on a metal surface. The present invention is configured for the entire shelving unit to fold down, collapse on itself, in that, the back panels of shelving unit and shelves lay down, parallel to each other.

Figure 1:
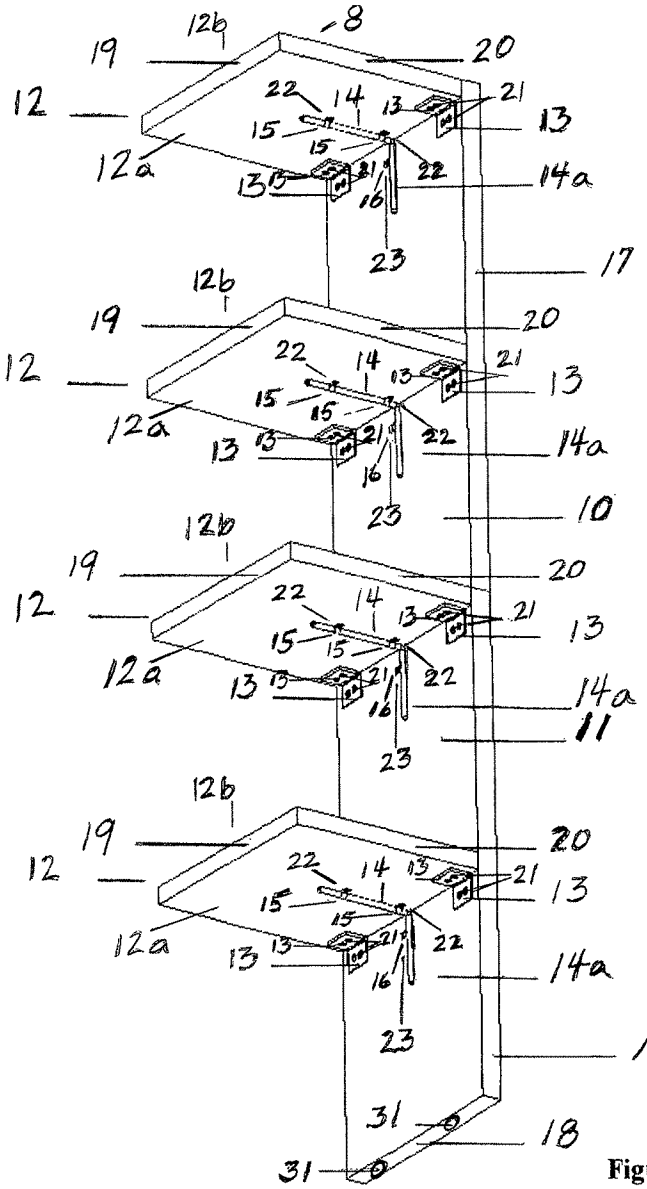
FIG. 1 is an inclusive view of the present invention convertible shelving II unit when open and in use according to being in a functioning position.

FIG. 1 provides an inclusive view of present invention convertible shelving II unit 8 in an open display for use, with two front face flat boards forming back panels 10 and 11, being shown with two flat shelves 12 hinged 13 with screws 21 to each back panel 10 and 11. Back panels 10 and 11 may be formed of any suitable material, e.g. wood, metal or plastic. Angle of convertible shelving II unit 8 displays a lateral side edge 17 of back panels 10 and 11, also showing two countersunk high-performance magnets 31, on bottom end edge 18 of back panel 11. The present invention convertible shelving II unit 8 includes one or more flat shelves 12 having an underside 12*a* and an upper side 12*b*. The view of the present invention convertible shelving II unit 8 displays shelves 12 side edge 20, and shelves 12 front edge 19, showing shelves 12 upright for use, extending perpendicular to front face of back panels 10 and 11. Shelves 12 may be formed of any suitable material, e.g. wood, metal or plastic. Shelves 12 underside 12*a* have hinges 13 and hinge screws 21 that attach shelves 12 to back panels 10 and 11 of the present invention convertible shelving II unit 8. Shelves 12 have a bracket rod 14 attached to underside 12*a* of shelves 12 clamped with two two-hole saddle clamps 15 and screws 22 to underside 12*a* of shelves 12 to hold bracket rod 14 parallel to underside 12*a* of shelves 12. A bracket rod 14 lower arm 14*a* rotates down ninety-degrees to support upright shelves 12 when shelves 12 are perpendicular to back panels 10 and 11, having a bracket rod 14 support stop 16 being a one-hole single line clamp with a screw 23 screwed into front face of back panels 10 and 11. A support stop 16 holds bracket rod 14 lower arm 14*a* in place when it is rotated down ninety-degrees to support upright shelve 12 extending perpendicular to back panels 10 and 11, A bracket rod 14 lower arm 14*a* rotates up ninety-degrees parallel to underside 12*a* of shelves 12 to collapse shelves 12 parallel to back panels 10 and 11 in order to adjust height clearance between shelves or for stow away.

Figure 2:
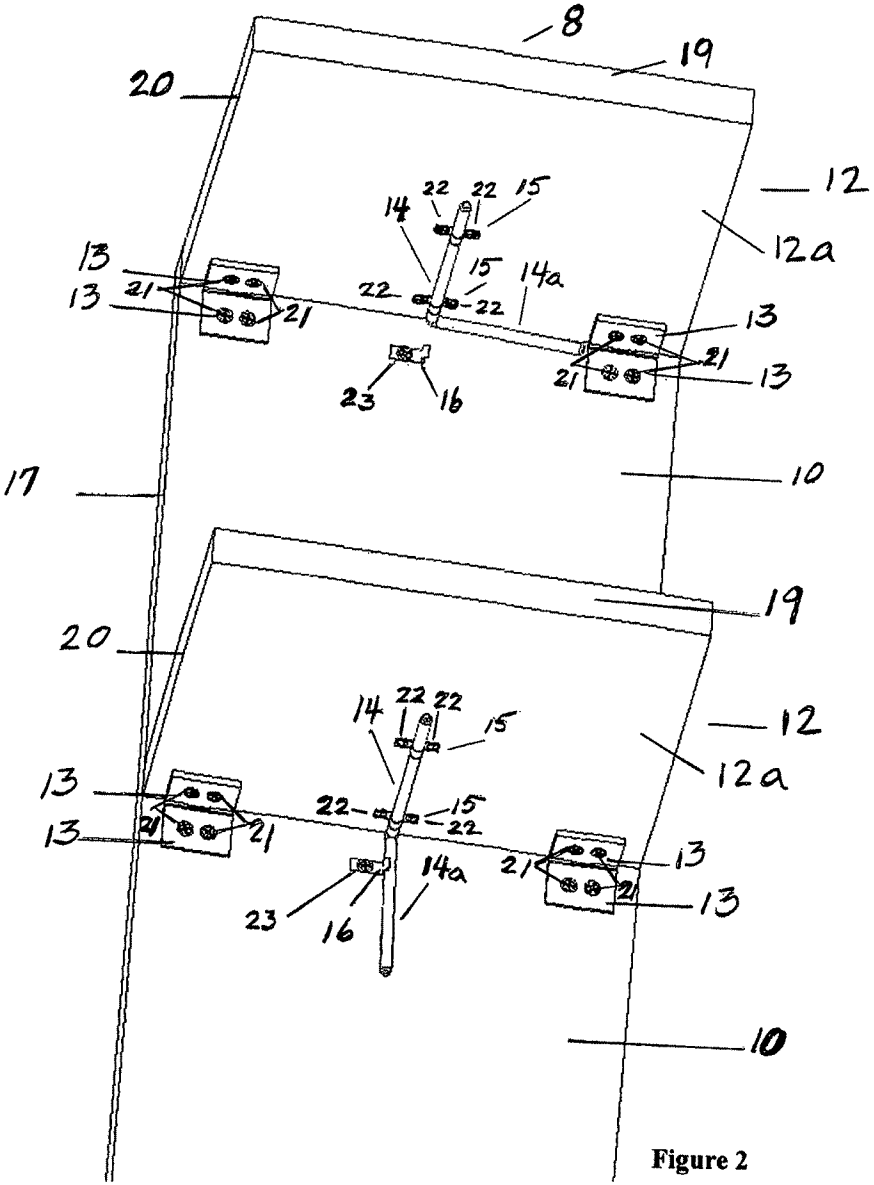
FIG. 2 is a detailed frontal view evaluation of hinged shelves attached to a flat board forming a back panel showing a bracket rod in two positions, one position showing the bracket rod's lower arm rotated up and one position showing the bracket rod's lower arm rotated down with bracket rod being held in place by a support stop.

FIG. 2 provide a detailed frontal view evaluation of present invention convertible shelving II unit 8 displays a shelve 12 with a hinge 13 and a screw 21 attached to a front face of flat board forming a back panel 10. Shelves 12 show side edge 20 and shelves 12 front edge 19, showing shelves 12 upright, extending perpendicular to front face of back panel 10 in an open display for use. Also displayed is a lateral side edge 17 of back panel 10. An underside 12*a* of shelves 12 display two hinges 13 and screws 21 that attach shelves 12 to vertical back panel 10. Shelves 12 showing a bracket rod 14 with screws 22 attached to underside 12*a* of shelves 12. A bracket rod 14 lower arm 14*a* rotates in two positions. The bracket rod 14 lower arm 14*a* rotates down ninety-degrees to support upright shelves 12 when shelves 12 are perpendicular to back panel 10, having a bracket rod

14 support stop 16 being a one-hole single line clamp with a screw 23 screwed into front face of back panel 10. The bracket rod 14 support stop 16 holds bracket rod 14 lower arm 14*a* in place when it is rotated down ninety-degrees to support upright shelve 12 extending perpendicular to back panel 10. The bracket rod 14 lower arm 14*a* rotates up ninety-degrees parallel to underside 12*a* of shelves 12 to collapse shelves 12 parallel to a back panel 10.

Figure 3:
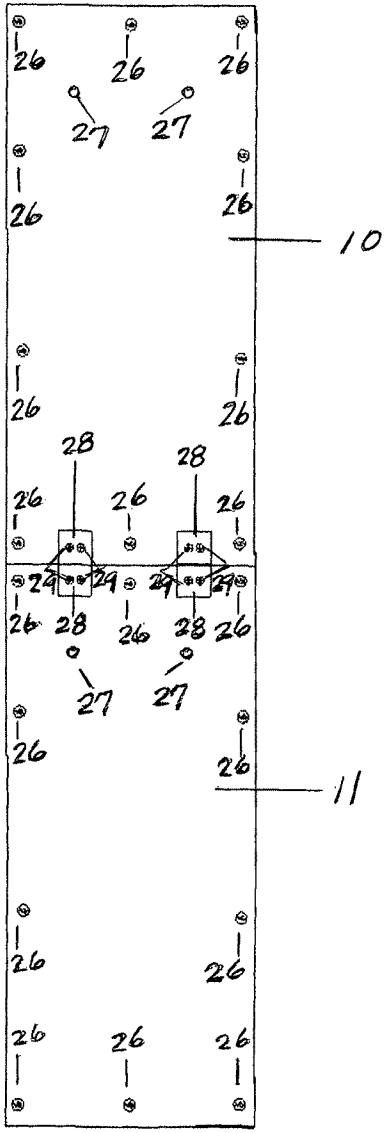
FIG. 3 is a rear view of more than one hinged flat back panel showing hinges, wall mount holes and high-performance magnets.

FIG. 3 provides a rear view of the present invention convertible shelving II unit 8 two flat boards forming back panels 10 and 11 showing a rear face of back panels 10 and 11 with a hinge 28, a wall mount hole 27 and a high-performance magnet 26. Two hinges 28 with screws 29 attach the rear face of bottom edge of back panel 10 to rear the face of top edge of back panel 11. Wall mounts 27 are configured to hang back panels 10 and 11 on a wall. High-performance magnets 26 are attached to rear face of back panels 10 and 11 configured to attach to a metal surface. High-performance magnets 26 sit on surface of rear face panel and can be affixed to rear face of back panels using a two-part epoxy or attached using a countersink screw drilled through high-performance magnet 26 into rear face of back panels 10 and 11.

Figure 4:
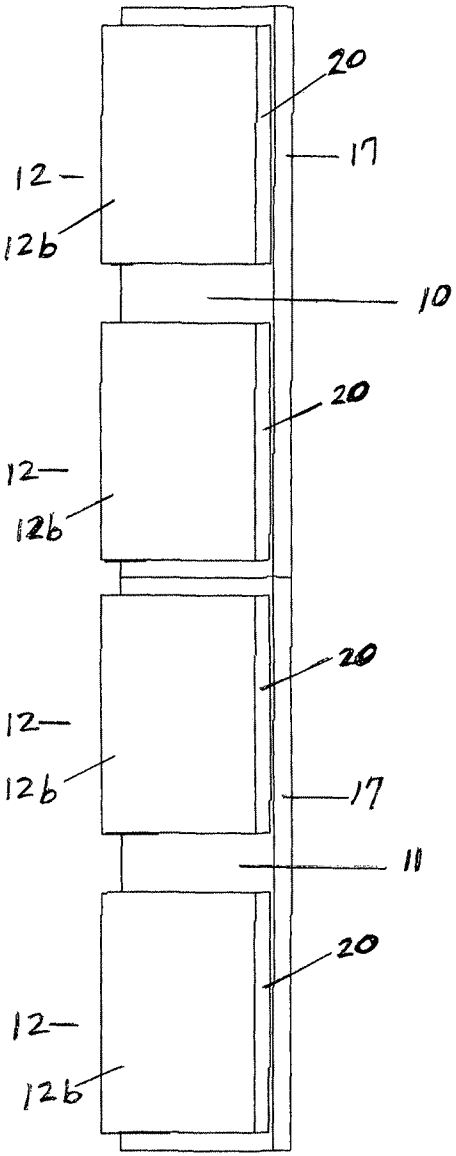
FIG. 4 is a frontal view of shelves collapsed and parallel to flat back panels.

FIG. 4 provides frontal view of the present invention convertible shelving II unit 8 showing upper side 12*b* of shelves 12 with shelves 12 collapsed and parallel to flat board forming back panels 10 and 11. Also displayed is side edge 20 of shelves 12 and lateral side edge 17 of back panels 10 and 11.

Figure 5:
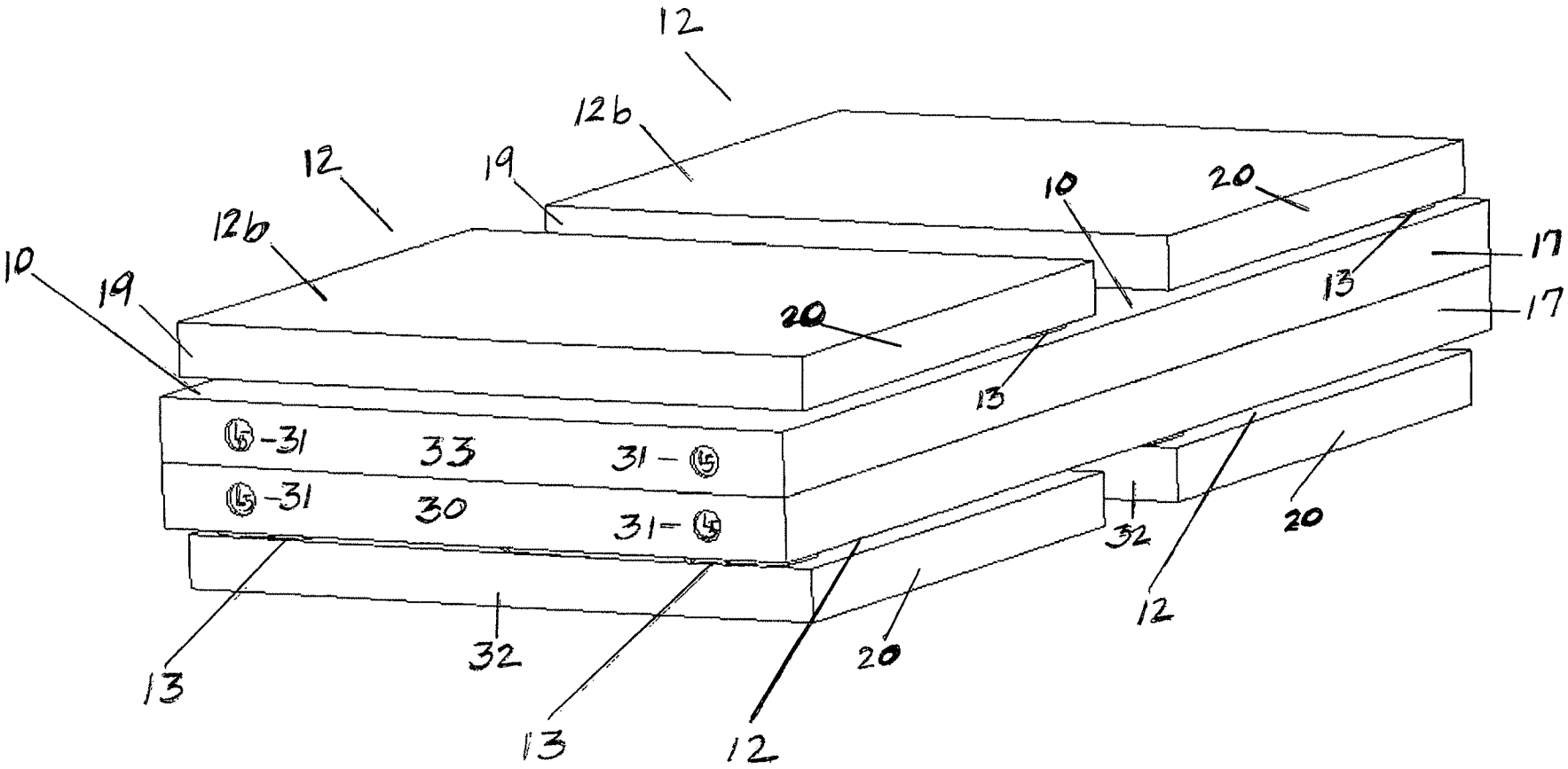
FIG. 5 is an evaluation of entire convertible shelving collapsed and folded with view of high-performance magnets on top end edge and bottom end edge of back panels.

FIG. 5 provide an evaluation of the present invention convertible shelving II 8 unit collapsed and folded with view of flat boards forming back panels 10 and 11, displaying back panels collapse parallel to each other, showing two countersunk high performance magnets 31 on bottom end edge 33 of back panel 10, and showing two countersunk high performance magnets 31 on top end edge 30 of back panel 11. Also displays the lateral side edge 17 of back panels 10 and 11, showing the lateral edge 20 and front edge 19 of shelves 12 along with a reference point of a front face of back panel 10. Shelves 12 folds collapsed onto back panels 10 and 11. On the front face of back panel 10, two collapsed shelves 12 shows upper side 12*b* of shelves, an edge of hinge 13 slightly displayed under side edge 20 that attaches shelves 12 to back panel 10. The collapsed shelves 12 shows the edge of a hinge 13 slightly displayed on underside 12*a* of shelves 12 attached to back panel 11. The rear edge 32 of shelves 12 shows hinges 13 that attaches shelves 12 to back panel 11.

In conclusion, the present invention convertible shelving II unit in its expression is unique in its function and purpose. As a novel multifunctional and useful shelving unit it can be utilized in areas that have constricted or limited spaces like a college dorm room, a studio apartment, having versatility to adhere to a side of a metal filing cabinet, a library metal dumb waiter or to a metal school locker.

The present invention convertible shelving II unit includes flexibility. The present invention convertible shelving II unit may be folded for convenient stow away with shelves collapse onto a back panel where the back panels collapse on themselves. The present invention convertible shelving II may be promptly and simply installed, moved, removed and stowed away. The present invention convertible shelving II unit is configured to hang on a wall using a wall mount hole on the rear face of one or more back panels. The present convertible shelving II invention has the versatility of use configured to affix on a metal surface by one or more high-performance magnets attached to rear face of back panel. Wherein high-performance magnets, e.g. PowerMags located on surface of rear face of one or more shelving unit back panel configured to hang the present convertible shelving II unit on a side of a filing cabinet, on a library dumb waiter or in a school locker. The present invention includes one or more countersunk high-performance magnets placed on back panels' top and bottom end edge where back panels meet end to end, thereby allowing back panel convertibility to add more back panels to extend a height of the back panel of a shelving unit. The collapsibility, adjustability and versatility of the present convertible shelving II unit can adjust spacing between shelves by simply collapsing them. For that reason, the practicality, handiness and usefulness of the present invention convertible shelving II unit with all parts being put together improves shelving solutions in constricted or limited spaces. The present invention has novel features of being user-friendly, provides easy mobility and easily stow away. Further includes novel features having changeable appearance and configuration of the positioning of back panels and shelves, has diverse surfaces on which to mount, e.g. a wall and a metal surface. The present invention convertible shelving II unit will be a fix for solving a shelving need, giving space solutions, value and function to constricted or limited spaces. The present invention convertible shelving II unit provides shelving solutions for use in constricted or limited spaces. The present invention shelving unit thereby allowing mobility, adjustability and easy installation. The present invention convertible shelving II unit has all parts pre-attached, eliminating a need for tools and eliminating a need to put it together. The present invention provides the shelving solution to meet a need in order to utilize constricted or limited spaces. The present invention convertible shelving II unit provide versatility in how, where and on what surface it can be used, either hang on a wall or affix to a metal surface with the added benefit of easy stow away due to its functional collapsibility.

We claim:

1. A convertible shelving unit, comprising:

a plurality of flat boards forming a back panel of the shelving unit, the back panel having a front face and a rear face, and a hinge on the rear face of the back panel connecting at least two of the flat boards end to end parallel to each other and allowing the at least two of the flat boards to fold back to back on each other and parallel to each other;

each flat board comprises one or more wall mount holes on the rear face of the back panel of the shelving unit configured to hang on a wall;

each flat board comprises first countersunk magnets secured to a top end edge and a bottom end edge of each flat board respectively by countersink screws or a two-part epoxy respectively to attach an additional flat board from said flat boards and extend a height of the back panel;

each flat board further comprises second magnets that are secured to each flat board by countersink screws or a two-part epoxy respectively to attach the rear face of the back panel to a metal surface;

wherein each flat board is formed of a material selected from a group consisting of wood, metal, and plastic;

each flat board having one or more shelves, each shelf has an upper side and an underside, wherein each shelf is hinged to a front surface of a corresponding flat board, each of the shelves is formed of a material selected from a group consisting of wood, metal and plastic;

wherein each shelf is movable between an upright position wherein each shelf extends perpendicular from the back panel and is configured to store items thereon, and a collapse position wherein each shelf is pivoted downwardly and each shelf is parallel to the back panel;

wherein each shelf includes a ninety-degree L-shaped bracket rod having an upper arm, attached to underside of each shelf respectively, wherein each shelf further includes a saddle clamp that is attach to the underside of each shelf respectively with a screw to hold each upper arm of each bracket rod in place;

wherein the front surface of each flat board includes a bracket support stop, wherein each bracket support stop comprises a flange and an open end that is configured to receive each corresponding bracket rod therein respectively, wherein a screw affixes the flange of each bracket support stop to each flat board respectively;

each ninety-degree L-shaped bracket rod further includes a lower arm that rotates about an axis ninety-degrees respectively between a horizontal orientation wherein each lower arm touches the underside of each shelf respectively to allow each shelf to pivot downwardly into the collapsed position, and a vertical orientation wherein each lower arm is received in the open end of each corresponding support stop respectively to maintain each shelf in the upright position respectively.

* * * * *